US011951361B2

(12) United States Patent
Booz et al.

(10) Patent No.: US 11,951,361 B2
(45) Date of Patent: Apr. 9, 2024

(54) BALL WITH A PLURALITY OF MECHANICAL SOUND-PRODUCING DEVICES

(71) Applicant: Handson Toys, Inc., Cambridge, MA (US)

(72) Inventors: Rustam Booz, Cambridge, MA (US); Andrew Farrar, Cambridge, MA (US)

(73) Assignee: HandsOn Toys, Inc., Cambridge, MA (US)

( * ) Notice: Subject to any disclaimer, the term of this patent is extended or adjusted under 35 U.S.C. 154(b) by 0 days.

(21) Appl. No.: 17/483,677

(22) Filed: Sep. 23, 2021

(65) Prior Publication Data

US 2022/0088443 A1 Mar. 24, 2022

Related U.S. Application Data

(60) Provisional application No. 63/082,329, filed on Sep. 23, 2020.

(51) Int. Cl.
*A63B 43/00* (2006.01)
*A63H 5/00* (2006.01)

(52) U.S. Cl.
CPC ..... *A63B 43/00* (2013.01); *A63H 5/00* (2013.01)

(58) Field of Classification Search
CPC ..... A63H 5/00
USPC ..... 446/397
See application file for complete search history.

(56) References Cited

U.S. PATENT DOCUMENTS 620,087 A * 2/1899 Stein ..... A63B 43/00 446/193
700,850 A * 5/1902 Stone ..... A63B 43/00 473/571
1,187,838 A * 6/1916 Hughes ..... A63B 43/00 473/571
1,193,992 A * 8/1916 Cigol ..... A63B 43/00 152/427
1,595,441 A * 8/1926 Zenger ..... A63B 43/00 473/571
3,599,307 A * 8/1971 Campbell ..... F16C 33/32 29/521
3,975,016 A * 8/1976 Bodor ..... A63B 43/00 473/610
4,991,847 A * 2/1991 Rudell ..... A63F 9/0278 473/594
5,253,866 A * 10/1993 Moorman ..... A63B 43/00 473/571
5,590,875 A * 1/1997 Young ..... A63B 59/50 D21/725
5,819,690 A * 10/1998 Brown ..... A01K 5/0114 119/710

(Continued)

*Primary Examiner* — Eugene L Kim
*Assistant Examiner* — Matthew B Stanczak
(74) *Attorney, Agent, or Firm* — Prince Lobel Tye LLP

(57) ABSTRACT

A toy ball which emits sounds as it is rolled and including a ball body and a plurality of mechanically-operated sound producing tubes carried within the ball body, each sound producing tube including a sound-producing device which moves by the force of gravity, and each sound producing tube lying along a longitudinal axis, in which the axes are transverse to one another so that the sound producing devices emit sound when the ball is rolled along various axes. The ends of the sound-producing tubes are held by sleeves that are molded as integral parts of the ball body.

11 Claims, 3 Drawing Sheets

(56) References Cited

U.S. PATENT DOCUMENTS 6,068,534 A * 5/2000 Strongin ..... A63B 43/00 446/213
6,073,581 A * 6/2000 Wang ..... A01K 5/0114 119/51.01
6,123,599 A * 9/2000 Chiang ..... A63H 5/00 446/81
6,393,992 B1 * 5/2002 Vasel ..... H02M 7/48 102/370
7,008,679 B2 * 3/2006 Cohen ..... G10D 13/24 428/34.1
7,976,417 B2 * 7/2011 Bagley ..... A63H 33/18 473/613
8,573,159 B1 * 11/2013 Crotty ..... A01K 15/025 119/707
9,370,167 B2 * 6/2016 Vap ..... A01K 29/00
9,579,582 B2 * 2/2017 Irie ..... A63H 3/06
9,664,512 B2 * 5/2017 Srinivasan ..... G01B 5/24
9,814,994 B1 * 11/2017 Woods ..... A63H 5/00
9,844,703 B1 * 12/2017 Gupta ..... A01K 15/025
9,992,975 B2 * 6/2018 Wolfe, Jr. ..... A01K 15/025
D834,300 S * 11/2018 Sapara, Jr. ..... D32/29.1
10,219,489 B2 * 3/2019 Ma ..... A01K 15/025
10,433,523 B2 * 10/2019 Stone ..... A01K 15/025
10,897,874 B2 * 1/2021 Stone ..... A01K 15/025
11,272,690 B2 * 3/2022 Gelardi, II ..... F16B 2/06
2003/0008727 A1 * 1/2003 Miller ..... A63B 43/00 473/571
2011/0214617 A1 * 9/2011 Markham ..... A01K 15/025 119/707
2016/0212975 A1 * 7/2016 Wolfe, Jr. ..... A01K 15/025
2017/0118957 A1 * 5/2017 Nunn ..... A01K 15/025
2017/0208776 A1 * 7/2017 Ma ..... A01K 15/025
2018/0070560 A1 * 3/2018 Gelardi, II ..... A63B 43/00
2018/0288971 A1 * 10/2018 Stone ..... G10K 9/10
2019/0133079 A1 * 5/2019 Jang ..... A01K 15/025
2020/0267935 A1 * 8/2020 Glaser ..... A63H 5/00

* cited by examiner

BALL WITH A PLURALITY OF MECHANICAL SOUND-PRODUCING DEVICES

CROSS-REFERENCE TO RELATED APPLICATION

This application claims priority of Provisional Patent Application 63/082,329 filed on Sep. 23, 2020, the entire disclosure of which is incorporated herein by reference.

BACKGROUND

This disclosure relates to a toy ball.

U.S. Pat. No. 6,068,534 discloses a ball with a plurality of mechanical sound tubes. The ends of the sound tubes are located close to the surface of the ball. The sound tubes can thus be damaged when the ball strikes the ground or a floor.

SUMMARY

All examples and features mentioned below can be combined in any technically possible way.

The sound-producing devices used in this invention preferably include a movable member which is moved by gravity as the orientation of the member changes by reason of movement of the ball. These sound-producing devices may be oriented such that the movement of the movable members of the devices occurs along transverse axes, which increases the likelihood of sound occurrence regardless of the manner in which the ball is moved. For example, three sound-producing devices can be arranged along substantially orthogonal axes, which ensures that sound will be produced upon virtually any rolling or other motion of the ball.

This invention features a toy ball which emits sounds as it is rolled, including a ball body and a plurality of mechanically-operated sound tubes carried within the ball body, each sound tube including a sliding whistle, reed, or other similar mechanical device from which sound is produced by movement of air through the device/The whistle moves by the force of gravity. Each sound tube lies along a longitudinal axis. The axes are transverse to one another so that the sound tubes emit sound when the ball is moved along various axes. In a preferred embodiment there are three sound tubes, and the three axes are orthogonal. The ball is preferably generally spherical with six indented areas, and the ends of each sound tube are located below the ball surface in an indented area to inhibit the sound tubes from contacting a surface against which the ball is contacted. In an example the ball can be bounced without the sound tubes contacting the surface on which the ball is bounced. Preferably, the sound tubes are entirely embedded within the ball body, and one or both ends of each sound tube are exposed to free air. The ball body may be hollow, and made from a pliable material. In that case, the ball may further include means for tightly holding the ends of each sound tube proximate and below the surface of the ball body, which may be accomplished with a tubular, inwardly-directed lip formed in the ball body, which partially overlays the end of each sound tube. The lip may lie below the apparent surface of the ball body to inhibit the ends of the tubes from contacting a surface against which the ball is contacted. In an example the ball is made by injection molding. The ball can be molded as two or more hollow or mostly hollow portions. The portions can then be fixed together to form a hollow ball with the sound tubes embedded in the ball.

In a preferred embodiment this invention features a toy ball which emits sounds as it is rolled, including a generally spherical ball body and three substantially orthogonal mechanically-operated sound tubes carried within the ball body. Each sound tube includes a sliding sound-producing device which moves along the tube by the force of gravity. Each sound tube lies along a longitudinal axis, and these axes are substantially orthogonal to one another so that the sound tubes emit sound when the ball is moved along or about various axes. The ball body includes six indented areas. The ends of each sound tube are located below the ball surface in an indented area, to inhibit the sound tubes from contacting a surface against which the ball is contacted.

In a more specific embodiment this invention features a toy ball which emits sounds as it is rolled, including a generally spherical, hollow ball body made from a pliable material and three substantially orthogonal mechanically operated sound tubes carried within the ball body. Each sound tube includes a sliding whistle which moves along the tube by the force of gravity. Each sound tube lies along a longitudinal axis. The three axes are substantially orthogonal to one another so that the sound tubes emit sound when the ball is moved along or about almost any axis. The ball body includes six indented areas. The ends of each sound tube are located below the ball surface in an indented area, to inhibit the sound tubes from contacting a surface against which the ball is contacted. The ball body includes six lips below its apparent surface, with a lip overlying each end of each sound tube, to tightly hold the ends of the sound tubes proximate but below the surface at the indented areas. The tubes can be closed by membranes that are integrally molded with the ball as parts of the lips. The membranes can be located at or close to the inner extent of each lip. The sound tubes are located in the ball interior, with each of the two ends of each tube held in a lip, and with the open end butted against or very close to a membrane. One or both membranes include openings, so that sound can escape the tube to the outside environment and be heard by a person or animal. In some examples the tubes are glued into the lips sitting against the membranes, to tightly hold the tubes in place. To facilitate gluing the tubes can be covered by a thin layer of the same material from which the ball and lips and membranes are made, so that the gluing involves gluing together two closely matched surfaces of the same material; this leads to a more secure glue joint.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Figure 1:
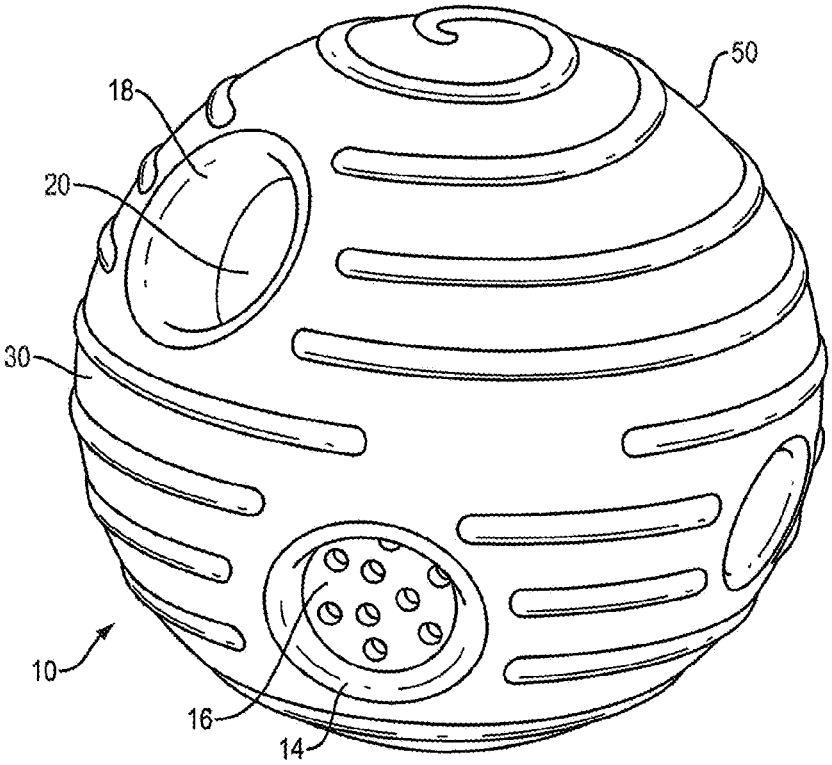
FIG. 1 is perspective view of a ball with plurality of mechanical sound-producing devices.

Examples of the balls, methods and apparatuses discussed herein are not limited in application to the details of construction and the arrangement of components set forth in the following description or illustrated in the accompanying drawings. The balls, methods and apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the ball products, systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

The sound-producing devices used in this invention preferably include a movable member which is moved by gravity as the orientation of the member changes by reason of movement of the ball. These sound-producing devices may be oriented such that the movement of the movable members of the devices occurs along transverse axes, which increases the likelihood of sound occurrence, regardless of the manner in which the ball is moved. For example, three sound-producing devices can be arranged along substantially orthogonal axes, which ensures that sound will be produced upon virtually any rolling or other motion of the ball.

This invention features a toy ball which emits sounds as it is rolled, including a ball body and a plurality of mechanically-operated sound tubes carried within the ball body, each sound tube including a sliding whistle which moves along the tube by the force of gravity, and each sound tube lying along a longitudinal axis, in which the axes are transverse to one another so that the sound tubes emit sound when the ball is moved along or about various axes. In a preferred embodiment there are three sound tubes, and the three axes are orthogonal. The ball is preferably generally spherical with six indented areas, and the ends of each sound tube are located below the ball surface in an indented area, to inhibit the sound tubes from contacting a surface against which the ball is contacted. In an example the ball can be bounced without the sound tubes contacting the surface on which the ball is bounced. Preferably, the sound tubes are entirely embedded within the ball body, and one or both ends of each sound tube are exposed to free air. The ball body may be hollow, and made from a pliable material. In that case the ball may further include means for tightly holding the ends of each sound tube proximate and below the surface of the ball body, which may be accomplished with a tubular, inwardly-directed lip formed in the ball body, which partially overlays the end of each sound tube. The overlap between the lip and sound tube may be reinforced with an adhesive. To facilitate the effectiveness of the adhesive the outside of the portion of the sound tube that is adhered to the lip may be made of or covered by the same material from which the ball and its integral lips are made. This way the adhesive joint is between two parts made of the same material, which can lead to stronger joint. The lip may lie below the apparent surface of the ball body, to inhibit the ends of the tubes from contacting a surface against which the ball is contacted. In an example the ball is made by injection molding. The ball can be molded as two or more hollow or mostly hollow portions. The portions can then be fixed together to form a hollow ball with the sound tubes embedded in the ball.

In a preferred embodiment, this invention features a toy ball which emits sounds as it is rolled, including a generally spherical ball body and three substantially orthogonal mechanically-operated sound tubes carried within the ball body. Each sound tube includes a sliding whistle which moves along a tube by the force of gravity. Each sound tube lies along a longitudinal axis, and these axes are substantially orthogonal to one another so that the sound tubes emit sound when the ball is moved along various axes. The ball body includes six indented areas, and the ends of each sound tube are located below the ball surface in an indented area, to inhibit the sound tubes from contacting a surface against which the ball is contacted.

In a more specific embodiment, this invention features a toy ball which emits sounds as it is rolled, including a generally spherical, hollow ball body made from a pliable material and three substantially orthogonal mechanically operated sound tubes carried within the ball body, each sound tube including a sliding whistle which moves along the tube by the force of gravity, and each sound tube lying along a longitudinal axis, in which the axes are substantially orthogonal to one another so that the sound tubes emit sound when the ball is moved along or about various axes. The ball body includes six indented areas, and the ends of each sound tube are located below the ball surface in an indented area, to inhibit the sound tubes from contacting a surface against which the ball is contacted. The ball body includes six lips below its apparent surface, with a lip at the most inward extent of each of the indented areas. Lips overlay both ends of each sound tube to tightly hold the ends of the sound tubes proximate but below the nominal spherical surface of the ball, at the indented areas. The tubes can be closed by membranes that are integrally molded with the ball. The membranes can be located between the inner and outer extent of each lip. The sound tubes are located in the ball interior, with each of the two ends of each tube held in a lip, and with the end butted against a membrane. One or both membranes include openings, so that sound can escape the tube to the outside environment and be heard by a person or animal. In some examples the tubes are glued into the lips while sitting against or close to the membranes, to tightly hold the tubes in place. To facilitate gluing the tubes can be covered by a thin layer of the same material from which the ball and lips and membranes are made, so that the gluing involves gluing together two closely matched surfaces of the same material; this leads to a more secure glue joint.

Figure 2B:
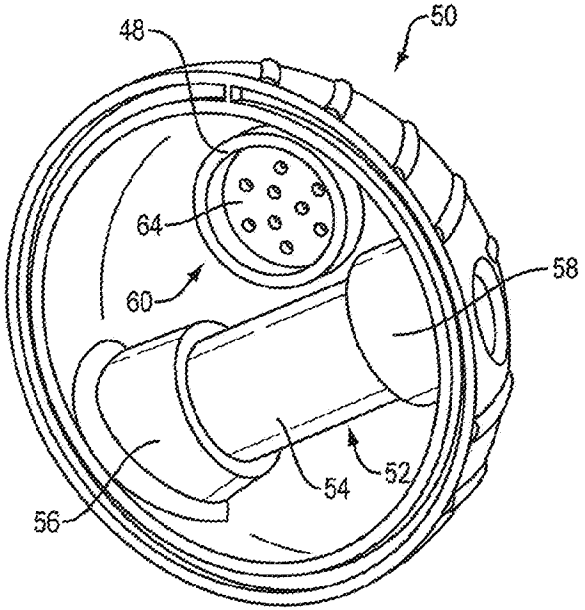
FIGS. 2A and 2B are perspective interior views of the two halves of the ball of FIG. 1 before the halves are coupled together.
Figure 2A:
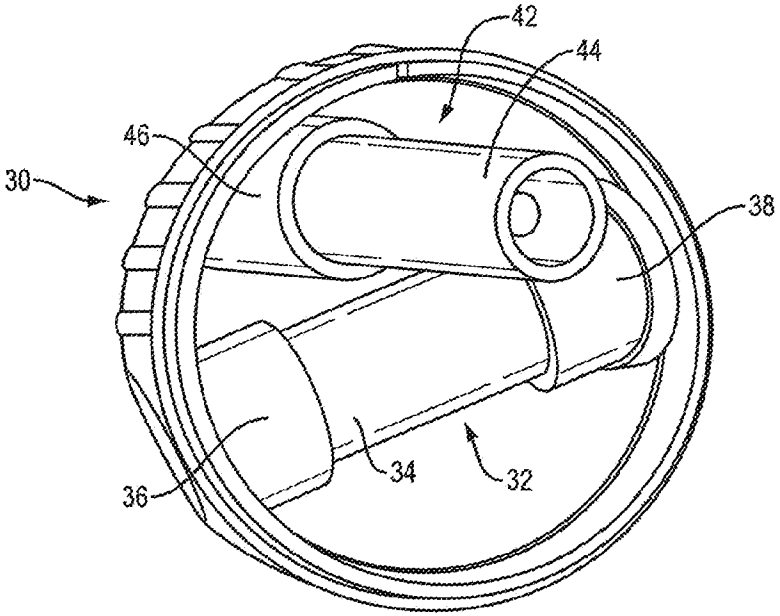

FIGS. 1, 2A, and 2B of the drawings depict a non-limiting example of toy ball 10 according to this invention. Ball 10 is made from two generally semi-spherical halves 30 and 50. Each half is hollow except that one carries on the inside two sound tubes and the other half carries one sound tube. The half with one sound tube includes the lip and integral membrane for one of the two sound tubes in the other half. When the two halves are fixed together (e.g., by inserting the one tube with a free end into the open lip and then gluing the halves together along glued joints/joining surfaces 31 and 51), the ball includes three sound tubes that lie along transverse axes and the sound tubes traverse the hollow interior. This way, as the ball is rolled one or more of the sound tubes will produce sound. The ball could alternatively include two non-parallel sound tubes, or more than three sound tubes. Also, other mechanical sound producing devices could be used, and oriented such that they make sound as the ball is rolled about different axes. Further, the ball could be made from two or more portions, each of which comprises a portion of the assembled ball. Each portion can be made by injection molding. For example, there could be two portions, one making up more than half of the ball and the other making up the rest of the ball. Or there could be three or more portions. The portions are fixed together to create the ball.

In an example the sound tubes or sound tube constructions 32, 42, 52, are identical, each including a rigid tube 34, 44, 54, respectively that can be made of ABS plastic, and inwardly-protruding tubes or lips 36 and 38, 46 and 48, and 56 and 58, respectively. Each sound tube includes a sliding whistle (not shown) that is configured to slide in two directions along the inside of the tube due to gravity. In an example assembly 60 includes tubular sleeve or lip portion 48 with integral membrane 64, which in this case has openings and so is like a screen. The membrane at the other end of the tube could be closed, or could also have openings.

The three sound tubes are embedded in the ball, with their ends located below the apparent surface (i.e., the surface that a spherical ball would have were it not for the indents and the sleeves that carry the ends of the tubes). Both ends of each tube are held in place by an internal sleeve such as sleeve 48. In one example the sleeves are thickened portions of the molded ball portion. In other words, the sleeves are integral portions of a unitary molded ball portion. The ball portions can be molded of a soft resilient substance such as a thermoplastic elastomer or a thermoplastic rubber. Since the ball is hollow, it will bounce.

In the illustrated example one half includes a circular tongue around its entire lip, while the other half includes a tongue-receiving groove around its mating lip. The tongue and groove joint is held together with an appropriate glue for the material from which the ball is made.

The two halves are assembled together by marrying them such that tube 44 fits into sleeve 48 with membrane 64 held against or close to, and overlying and thus closing the open end of the tube so that the sliding whistle is maintained in the tube. The tongue and groove joint can be fixed together in a desired fashion, such as by use of an adhesive or by heat or sonic welding, for example.

The end result is a ball where the ends of the tubes are held well below the ball surface, and held by a thick sleeve made of a relatively soft material with some give, so that the ball can compress as it strikes a surface around the tube end, while still protecting the end of the tube. The ball can thus be bounced and thrown with less danger of cracking or breaking a tube as compared to the ball of U.S. Pat. No. 6,068,534.

The subject ball is generally spherical and carries in its mainly hollow interior one or more sound tubes. Each sound tube is configured to create sound as the ball is rolled or otherwise moved. In some examples the sound tubes are of a type known in the field, wherein a sliding whistle is located inside of the hollow tube. The whistle is configured to slide along the tube interior under the influence of gravity. Thus, when the tube is tilted from the horizontal, the whistle slides and produces sound. Each sound tube includes one or more openings that are open to the external environment outside of the ball, so the sound is able to escape into the environment and be heard by people and animals. The two ends of each tube are embedded into the material from which the ball is made and located below the nominal surface of the ball (if it was fully spherical). This way the tube ends are protected from impacting a surface on which the ball is located.

Figure 3:
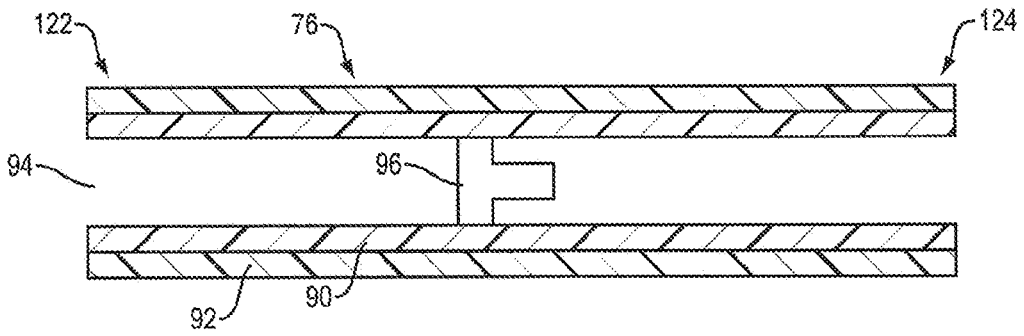
FIG. 3 is a cross-sectional view of a sound tube for a ball with plurality of mechanical sound-producing devices.
Figure 4:
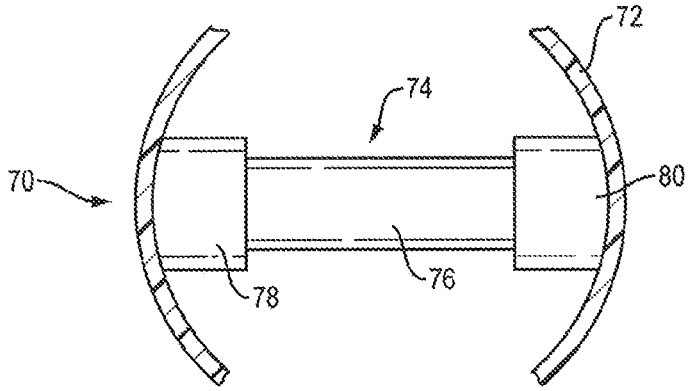
FIG. 4 is a partial view of a ball with plurality of mechanical sound-producing devices, illustrating the sound tube of FIG. 3 held inside the ball.
Figure 5:
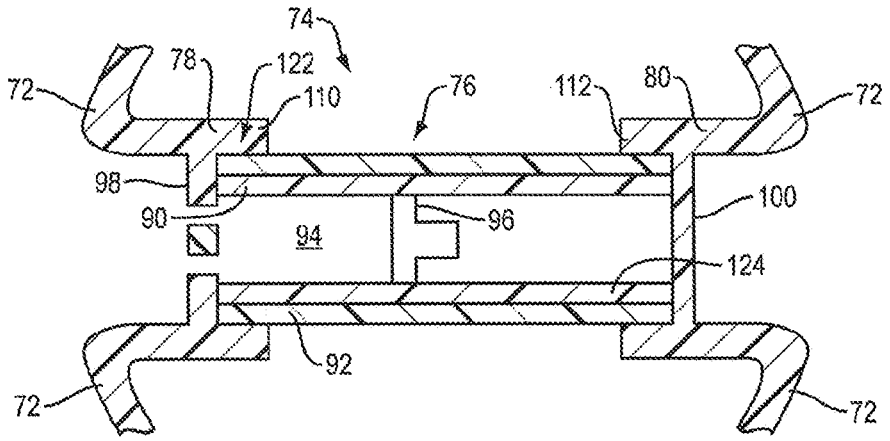
FIG. 5 is a cross-sectional view similar to that of FIG. 4.

Sound tube fixing inside the ball can also be accomplished as illustrated in FIGS. 3-5. Sound tube 76 includes hard tube 90 with interior 94. Sliding whistle 96 is located in and is configured to be able to slide along the inside of the tube. Tube 90 is coated with a thin over coating 92 of the plastic material from which the ball is molded. Sound tube assembly 74, FIG. 5, illustrates sound tube 76 fixed in place in the interiors of inwardly-directed and protruding integral tubular portions (sleeves or lips) 78 and 80 of ball body 72. Portions 78 and 80 are thicker than is the rest of the ball, to tightly hold and reinforce the ends of the sound tube.

More detail of the manner in which sound tube ends 122 and 124 are held in the ball material are shown in FIG. 5. Integral inwardly-protruding ball tubular portion or sleeve 78 includes thickened interior end portion 110 and opposite integral inwardly-protruding ball tubular portion or sleeve 80 includes thickened interior end portion 112. End cap 98 (with openings) is an integral part of portion 110 and closed end cap 100 is an integral part of end portion 112. Portions 110 and 112 are configured such that they tightly overlay tube ends 122 and 124, respectively, with the open ends of the tube butted up against end caps 98 and 100. An adhesive (not shown) can be used along the joints between the tube and end portions 110 and 112. As is clear from FIG. 5, ends 122 and 124 of tube 76 are held below the nominal spherical outer surface of ball body 72, at the lower extent of generally conical indentations created by the inwardly-directed tubular portion ends lying below the ball surface.

In an example, ball body 72 is molded of a relatively soft material. A part of the spherical body is left open, so that the molded member includes an opening that is large enough for the sound tubes to be manually placed into the hollow interior with each end in one integral sleeve. Adhesive can be applied to the ends of the tube and/or the inside of the sleeves, to bond the sound tube into the two sleeves. After the three sound tubes have been fixed in place a separate ball body portion that has a size and shaped to close the opening in the ball while still maintaining its spherical shape, is glued in place to cover the opening and thus close the ball. An alternative construction is such as shown in FIGS. 1, 2A and 2B, where one end of one tube is fixed in place at the same time that the two halves of the ball are fixed together. Other manners of construction would be apparent to one skilled in the technical field.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A toy ball which emits sounds as it is rolled and that is constructed and arranged to bounce on a surface, comprising:

a hollow ball body with an interior, wherein the ball body comprises two ball portions, each of which is a unitary molded part that is made of a soft resilient thermoplastic substance; and a plurality of mechanically-operated sound producing hollow rigid tubes entirely embedded within the interior of the ball body, each sound producing tube having first and second opposed open ends and including a sound-producing device which moves by the force of gravity, and each sound producing tube lying along a longitudinal axis, in which the axes are transverse to one another so that the sound producing tubes emit sound when the ball is rolled along various axes;

wherein the ball body comprises six unitary integral inwardly-protruding tubular sleeves that are each part of one of the unitary ball body portions, wherein each sleeve protrudes into the interior of the ball body, and wherein the sleeves are arranged as three pairs of opposed sleeves, wherein each sleeve defines a unitary integral end cap and wherein the end cap of at least one sleeve of each pair of sleeves includes at least one opening that is configured to expose an interior of a tube to free air;

wherein the ends of the sound-producing tubes are each held in one sleeve, with the end of the tube butted up against the integral end cap of the sleeve with the integral end caps overlying the entireties of the ends of the sound-producing tubes, so that the sound producing tubes are protected by the end caps from impacting the surface on which the toy ball is bounced.

2. The toy ball of claim 1, wherein each sound producing tube is a sound tube with a sliding whistle.

3. The toy ball of claim 1, wherein the toy ball includes three sound tubes.

4. The toy ball of claim 3, wherein the axes are orthogonal.

5. The toy ball of claim 3, wherein the ball is spherical with six indented areas, and in which the ends of each sound tube are located below the ball surface in an indented area, to inhibit the sound tubes from contacting a surface against which the ball is contacted.

6. The toy ball of claim 1, wherein the ball body is made from two halves that are separately molded and then fixed together.

7. The toy ball of claim 6, wherein the two halves are fixed together with a tongue and groove joint.

8. The toy ball of claim 1, wherein the ball body is made from a plurality of portions that are separately molded and then fixed together.

9. The toy ball of claim 8, wherein the ball body is made from two portions.

10. The toy ball of claim 9, wherein each portion of the ball body includes three integral sleeves.

11. The toy ball of claim 1, wherein each sound producing tube comprises a hard tube coated on its outside with a thin over coating of the plastic material from which the ball body is made.

* * * * *